US010857817B2

(12) United States Patent
Furuya et al.

(10) Patent No.: US 10,857,817 B2
(45) Date of Patent: Dec. 8, 2020

(54) RECORDING APPARATUS

(71) Applicant: SEIKO EPSON CORPORATION, Tokyo (JP)

(72) Inventors: Kenichi Furuya, Shiojiri (JP); Kazuo Saito, Shiojiri (JP); Eiji Taketsugu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/960,688

(22) Filed: Apr. 24, 2018

(65) Prior Publication Data

US 2018/0311976 A1 Nov. 1, 2018

(30) Foreign Application Priority Data

Apr. 28, 2017 (JP) ..... 2017-089390

(51) Int. Cl.

| | |
|---|---|
| ***B41J 11/00*** | (2006.01) |
| ***B65H 5/38*** | (2006.01) |
| ***B41J 2/145*** | (2006.01) |
| ***B41J 11/06*** | (2006.01) |

(52) U.S. Cl.

CPC ..... *B41J 11/0045* (2013.01); *B41J 2/145* (2013.01); *B41J 11/005* (2013.01); *B41J 11/0065* (2013.01); *B41J 11/06* (2013.01); *B65H 5/38* (2013.01)

(58) Field of Classification Search

None

See application file for complete search history.

(56) References Cited

U.S. PATENT DOCUMENTS

| | | | | |
|---|---|---|---|---|
| 7,255,434 | B2 * | 8/2007 | Kodama | B41J 2/185 347/108 |
| 7,416,296 | B2 * | 8/2008 | Takeda | B41J 11/06 347/104 |
| 2003/0025777 | A1 * | 2/2003 | Sugiyama | B41J 11/06 347/104 |
| 2008/0074458 | A1 | 3/2008 | Niioka et al. | |
| 2013/0135409 | A1 | 5/2013 | Ito et al. | |
| 2014/0146118 | A1 | 5/2014 | Ito et al. | |

FOREIGN PATENT DOCUMENTS

| | | |
|---|---|---|
| JP | 2008-074063 A | 4/2008 |
| JP | 2016-036936 A | 3/2016 |
| JP | 5962561 B | 7/2016 |

* cited by examiner

*Primary Examiner* — Alejandro Valencia

(74) *Attorney, Agent, or Firm* — Workman Nydegger

(57) ABSTRACT

There is provided a recording apparatus including a recording head, a support member which is disposed to face the recording head and on which a plurality of ribs for supporting a medium are formed, the plurality of ribs include a plurality of first ribs which are provided in a medium width direction and a plurality of second ribs which are positioned on a downstream side from the first ribs and are provided in the medium width direction, each of the second ribs has a guide surface for scooping up a leading edge of the medium which is fed backward, and the guide surface includes a first guide surface which is formed on each of the second ribs and a second guide surface which is formed on each of the second ribs.

6 Claims, 12 Drawing Sheets

RECORDING APPARATUS

BACKGROUND

1. Technical Field

The present invention relates to a recording apparatus for performing recording on a medium.

2. Related Art

In recording apparatuses represented by a facsimile machine, a printer, or the like, particularly an ink jet printer, a support member (also referred to as a platen) is provided at a position facing a recording head, the support member including a plurality of ribs for supporting a recording paper as a medium which are disposed at an appropriate interval along a direction orthogonal to a paper transport direction, that is, a paper width direction (see, for example, Japanese Patent No. 5962561).

The recording paper swells by absorbing ink and forms a corrugation shape (cockling) in which a mountain is formed at a position of the rib of the support member, and a valley is formed between the ribs.

In a case where recording is performed on both surfaces of the recording paper, the recording paper for which recording has been performed on a first surface is not discharged but is fed backward, and is transported again to the recording position via a reverse path. In a case where the backward feeding is performed, it is preferable to form a guide slope for scooping up a paper leading edge (a trailing edge when recording is performed on the first surface) on a transport direction-downstream side of the rib (a downstream side on the basis of a forward feeding direction of the recording paper) so that the paper leading edge is prevented from getting caught in the rib.

FIG. 12 is a schematic diagram for describing a technical problem of the invention. Reference numeral 105 indicates a recording head, and at positions facing the recording head 105, there are provided a first rib 101, a second rib 102, a third rib 103, and a fourth rib 104 from an upstream side toward a downstream side in the forward feeding direction (from right to left in the drawing) of the recording paper.

The trailing edge of the recording paper P for which recording is to be performed on both surfaces is transported in a backward feeding direction (from left to right in the drawing) after recording has been performed on the first surface. Thus, the guide slope for scooping up the paper leading edge Pt is formed so that the paper leading edge Pt is prevented from getting caught in each rib at the time of being fed backward. As an example, reference numeral Sa indicates a guide slope formed on a downstream side of the second rib 102 in the forward feeding direction.

It is preferable that the guide slope Sa be made longer and a start position thereof be at a lower side, from the viewpoint of scooping up the paper leading edge Pt. However, in a case where the guide slope Sa is formed to be long, for example, as indicated by a broken line and reference numeral Sb, a length of the second rib 102 also has to be increased.

In a borderless recording in which recording without any margin is performed on edges of the recording paper P, a space between the ribs is used as an ink disposal area. Thus, in a case where a length of the rib itself is long, the ink disposal area narrows, thereby inevitably restricting the number of ink ejection nozzles to be used. Referring to FIG. 12, a range L1 indicates a usable range for the ink ejection nozzles in a case of the guide slope Sa, and a range L2 indicates a usable range for the ink ejection nozzles in a case of the guide slope Sb. As shown in the drawing, in the case of the guide slope Sb which is made longer and of which the start position is at a lower side, the usable range for the ink ejection nozzles narrows, and as a result, a printing throughput is lowered.

SUMMARY

An advantage of some aspects of the invention is to provide a recording apparatus which takes into consideration both a paper leading edge getting caught in a rib when a recording paper is fed backward and prevention of a printing throughput from being lowered.

According to an aspect of the invention, there is provided a recording apparatus including: a recording head which performs recording on a medium; a support member which is disposed to face the recording head and on which a plurality of ribs for supporting the medium are formed, the plurality of ribs include a plurality of first ribs which are spaced apart from one another at an appropriate interval in a medium width direction that is a direction intersecting with the medium transport direction, and a plurality of second ribs which are positioned on a downstream side from the first ribs in the medium transport direction, and are spaced apart from one another at an appropriate interval in the medium width direction, in which each of the second ribs has a guide surface for scooping up a leading edge of the medium which is fed backward from a downstream side to an upstream side in the medium transport direction, in which the guide surface includes a first guide surface which is formed on each of the second ribs positioned within a first region in the medium width direction, and a second guide surface which is formed on each of the second ribs positioned outside the first region in the medium width direction, and in which a medium transport direction-downstream side end portion of the second guide surface is positioned on a downstream side from a medium transport direction-downstream side end portion of the first guide surface and has a lower height position than a height position for the medium transport direction-downstream side end portion of the first guide surface.

A borderless recording, for example, tends to be performed more frequently for a medium having a relatively small size such as an L-type photograph size than a medium having a relatively large size such as an A4 size. Therefore, prioritizing a throughput of the borderless recording for a medium having a small size over a throughput of the borderless recording for a medium having a large size is in line with users' needs.

Further, regarding the medium having a small size such as an L-type photograph size, for which the borderless recording is performed at a high frequency as described above, a dedicated paper is often used. In this case, because of a high paper stiffness (rigidity), hanging-down at a leading edge hardly occurs, that is, getting-caught of a medium leading edge in a rib at the time of being fed backward hardly occurs. In addition, there are few cases where recording is performed by backward feeding.

On the contrary, regarding the medium having a relatively large size such as an A4 size, a plain paper is often used. In this case, because of a low paper stiffness (rigidity), hanging-down at the leading edge easily occurs, that is, getting-caught of the medium leading edge in the rib at the time of being fed backward easily occurs. In addition, even in a case of having a somewhat strong paper stiffness (rigidity), influence of curls also becomes large as a size of the medium increases, and getting-caught of the medium leading edge in the rib at the time of being fed backward easily occurs. Therefore, it is reasonable to prioritize prevention of the medium having a large size from getting caught in the rib over prevention of the medium having a small size from getting caught in the rib, from the viewpoint of obtaining a good recording result as a whole.

In this case, the above natures are utilized to make a configuration as follows. That is, in a configuration including the first ribs and the second ribs, each of the second ribs has a guide surface for scooping up the leading edge of the medium which is fed backward from the downstream side to the upstream side in the medium transport direction. The guide surface includes a first guide surface which is formed on each of the second ribs positioned within a first region in the medium width direction, and a second guide surface which is formed on each of the second ribs positioned outside the first region in the medium width direction, in which a medium transport direction-downstream side end portion of the second guide surface is positioned on a downstream side from a medium transport direction-downstream side end portion of the first guide surface and has a lower height position than a height position for the medium transport direction-downstream side end portion of the first guide surface.

That is, outside the first region, the guide surface (second guide surface) for scooping up the medium leading edge is formed to be longer and from a lower side. Thus, the leading edge of the medium having a large size can be prevented from getting caught in the rib.

On the other hand, in the first region, the guide surface (first guide surface) for scooping up the medium leading edge is shorter than the second guide surface. Thus, a region between the ribs (a region between the second rib and the third rib) can be secured wide, and a larger number of nozzles can be used, that is, restrictions on the ink ejection nozzles at the time of performing the borderless recording can be loosened, thereby preventing a recording throughput from being lowered.

In this way, it is possible to configure a recording apparatus which takes into consideration both the medium leading edge getting caught in the rib when the medium is fed backward and prevention of the recording throughput from being lowered.

In this specification, "medium transport direction" means a medium transport direction when recording is performed on the medium, that is, a forward feeding direction of the medium.

In the recording apparatus, the plurality of ribs may further include a plurality of third ribs which are positioned on a downstream side from the second ribs in the medium transport direction and are spaced apart from one another at an appropriate interval in the medium width direction, in which the recording head has a plurality of ink ejection nozzles along the medium transport direction, and in which the recording apparatus is capable of executing a first recording mode, in which the ink ejection nozzles to be used are restricted to the ink ejection nozzles which are positioned within a range between the medium transport direction-downstream side end portion of the second guide surface and an upstream side end portion of each of the third ribs in the medium transport direction, in a case where recording is performed on a wide medium of which edge portions in the medium width direction are positioned outside the first region, and a second recording mode, in which the ink ejection nozzles are positioned within a range between the medium transport direction-downstream side end portion of the first guide surface and the upstream side end portion of each of the third ribs in the medium transport direction and are used in a larger number than the ink ejection nozzles used in the first recording mode, in a case where recording is performed on a narrow medium of which edge portions in the medium width direction are positioned within the first region.

In this configuration, by applying the second recording mode to a medium of which width direction-edge portions are positioned within the first region, that is, a medium having a relatively small size, it is possible to use a larger number of ink ejection nozzles, thereby preventing a recording throughput from being lowered.

In the recording apparatus, the plurality of ribs may further include a plurality of fourth ribs which are positioned on a downstream side from the third ribs in the medium transport direction and are spaced apart from one another at an appropriate interval in the medium width direction, in which the plurality of ink ejection nozzles are configured to include a first nozzle group including the ink ejection nozzles which face a region between the first ribs and the second ribs in the medium transport direction, a second nozzle group including the ink ejection nozzles which face a region between the second ribs and the third ribs in the medium transport direction, and a third nozzle group including the ink ejection nozzles which face a region between the third ribs and the fourth ribs in the medium transport direction, and in which in the first recording mode, use of the ink ejection nozzles constituting the second nozzle group is restricted, and the number of the ink ejection nozzles constituting the first nozzle group or the third nozzle group matches the number of the ink ejection nozzles used in the second nozzle group.

In this configuration, in the first recording mode, use of the ink ejection nozzles constituting the second nozzle group is restricted, and the number of the ink ejection nozzles constituting the first nozzle group or the third nozzle group matches the number of the ink ejection nozzles used in the second nozzle group. Thus, in a case where inks of different colors are ejected from the first nozzle group, the second nozzle group, and the third nozzle group, and this is repeatedly done on the medium, an appropriate recording result can be obtained.

In the recording apparatus, an upstream side transport unit which is provided on an upstream side of the support member in a medium transport direction, a control unit which controls the upstream side transport unit may be further included, in which in a recording job in which recording is performed on both a first surface of the medium and a second surface opposite to the first surface, the control unit starts backward feeding of the medium at a position where the trailing edge of the medium for which recording on the first surface has been completed does not proceed to a downstream side from the third ribs.

In this configuration, in the recording job in which recording is performed on both the first surface of the medium and the second surface opposite to the first surface, the control unit which controls the upstream side transport unit starts backward feeding of the medium at the position where the trailing edge of the medium for which recording on the first surface has been completed does not proceed to a downstream side from the third ribs. Thus, the medium leading edge does not need to climb over the third ribs when the medium is fed backward, that is, it is possible to reduce the number of ribs over which the medium leading edge passes when the medium is fed backward, thereby suppressing a probability of jamming.

In the recording apparatus, the plurality of fourth ribs provided along the medium width direction may be formed to have uneven heights.

In this configuration, the plurality of fourth ribs provided along the medium width direction are formed to have uneven heights. Thus, by adjusting heights of the fourth ribs in response to heights of corrugation shaped valleys formed on the medium, it is possible to prevent the medium leading edge from colliding with the ribs and to realize a more appropriate transport of the medium.

In the recording apparatus, a position of the medium transport direction-upstream side end portion of each of the second ribs positioned within the first region and a position of the medium transport direction-upstream side end portion of each of the second ribs positioned outside the first region may match with each other.

In this configuration, the position of the medium transport direction-upstream side end portion of each of the second ribs positioned within the first region and the position of the medium transport direction-upstream side end portion of each of the second ribs positioned outside the first region match with each other. Thus, it is possible to allow the intervals between the first ribs and the second ribs in the medium transport direction to match with one another in the medium transport direction. As a result, regardless of a medium size, a region between the first ribs and the second ribs can be maximally used.

In the recording apparatus, each of the ribs may have an upstream guide surface for scooping up the leading edge of the medium which is fed forward from an upstream side to a downstream side in the medium transport direction.

In this configuration, each rib has the upstream guide surface for scooping up the leading edge of the medium which is fed forward from the upstream side to the downstream side in the medium transport direction. Thus, when the medium is transported in the forward feeding direction, it is possible to prevent the medium leading edge from getting caught in the rib.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
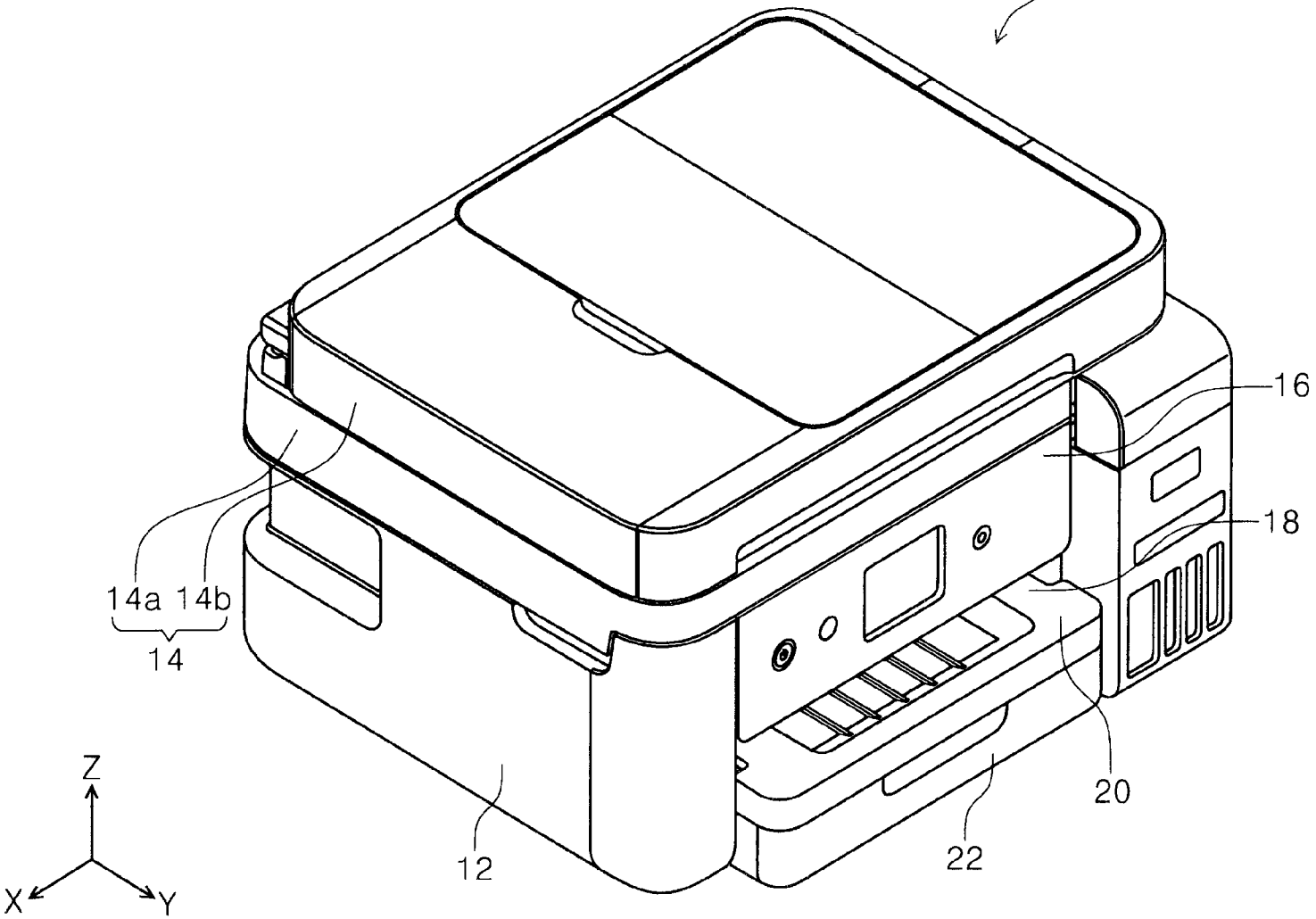
FIG. 1 is an external perspective view of a printer according to the invention.

Hereinafter, embodiments of the invention will be described with reference to the drawings. In the respective examples, the same configuration is designated by the same reference numeral and will be described in only a first example, and the description for the configuration will be omitted in the subsequent examples.

Figure 2:
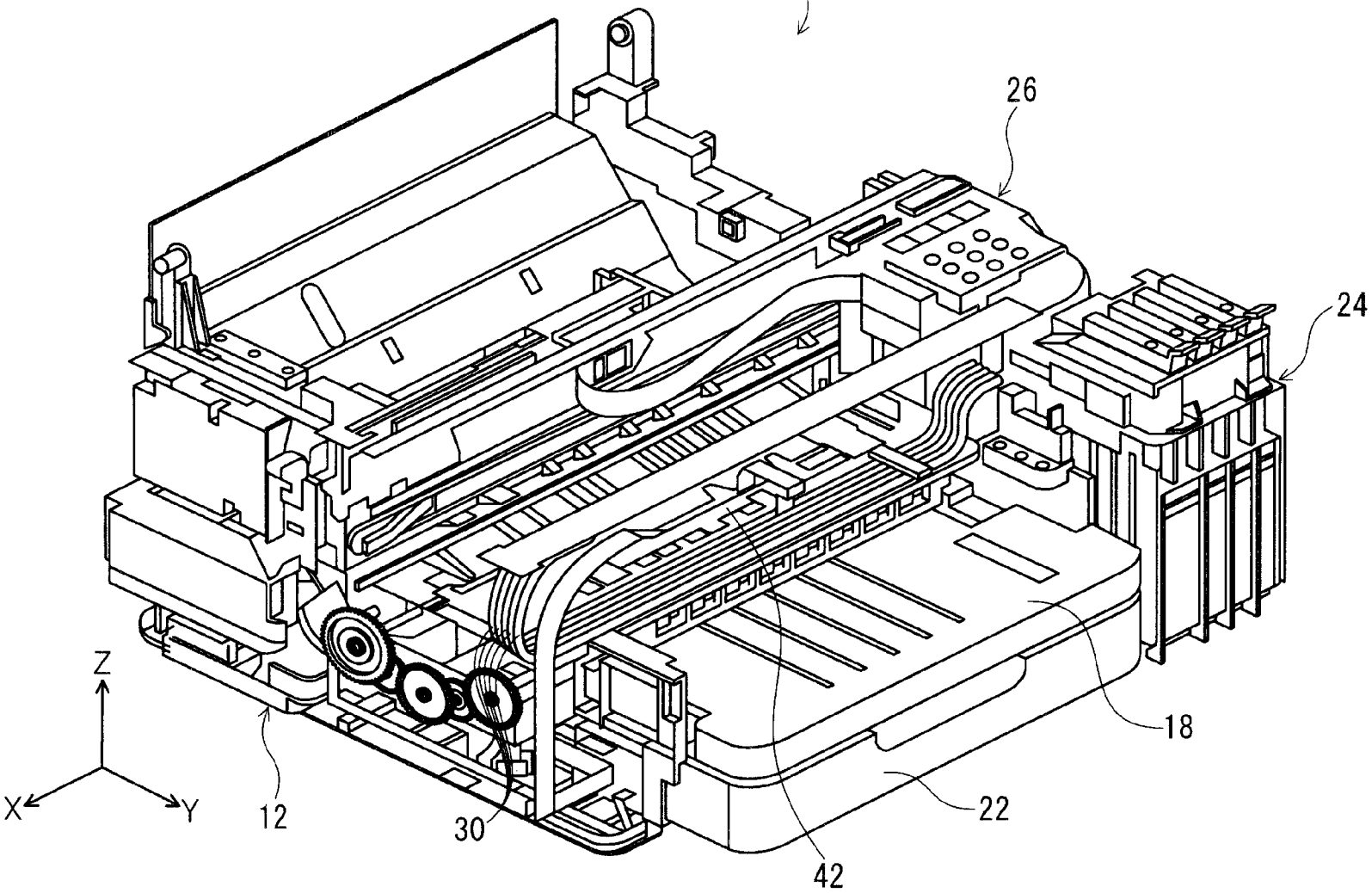
FIG. 2 is a perspective view of an apparatus main body according to the invention.
Figure 3:
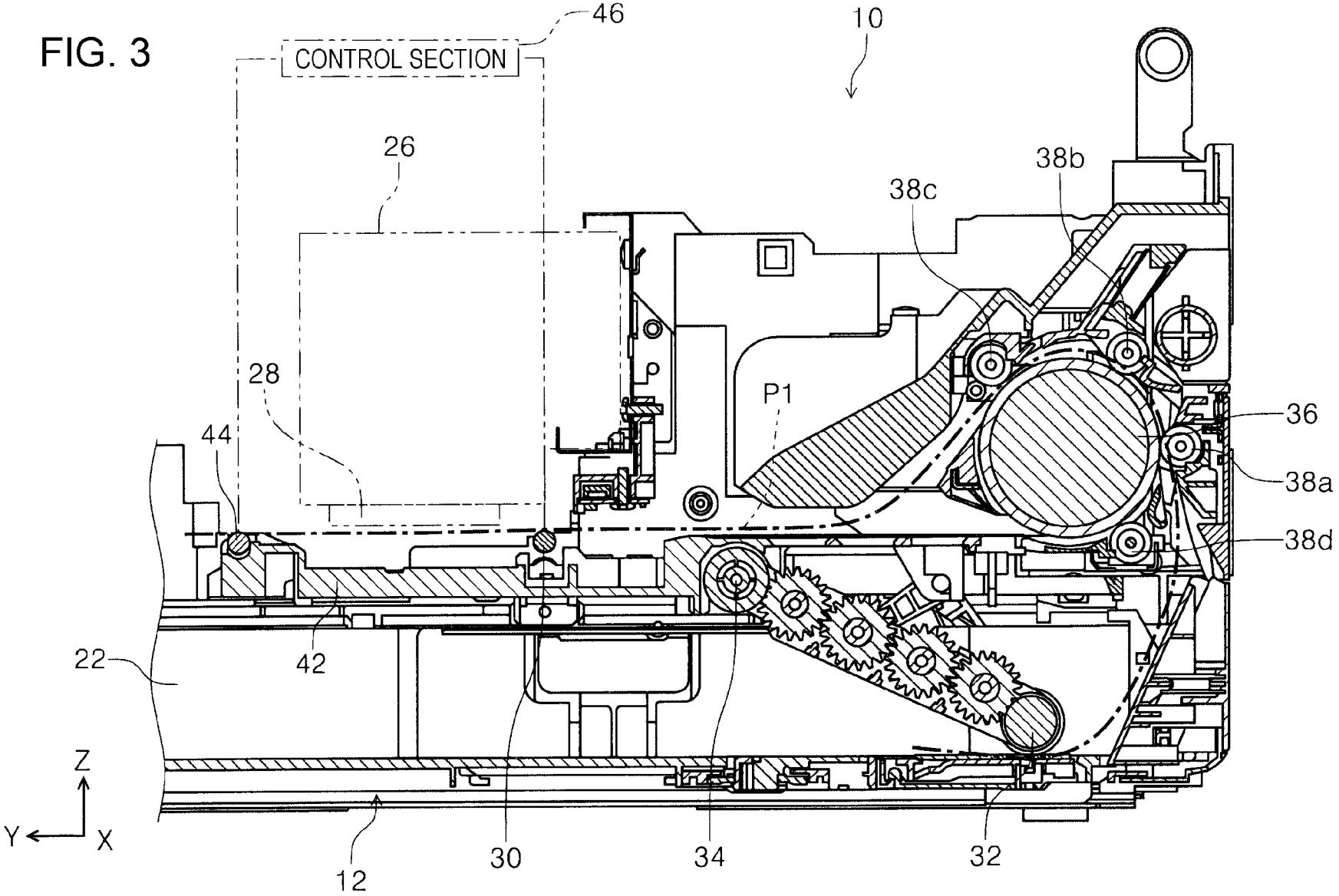
FIG. 3 is a side sectional view showing a medium transport path of the printer according to the invention.
Figure 4:
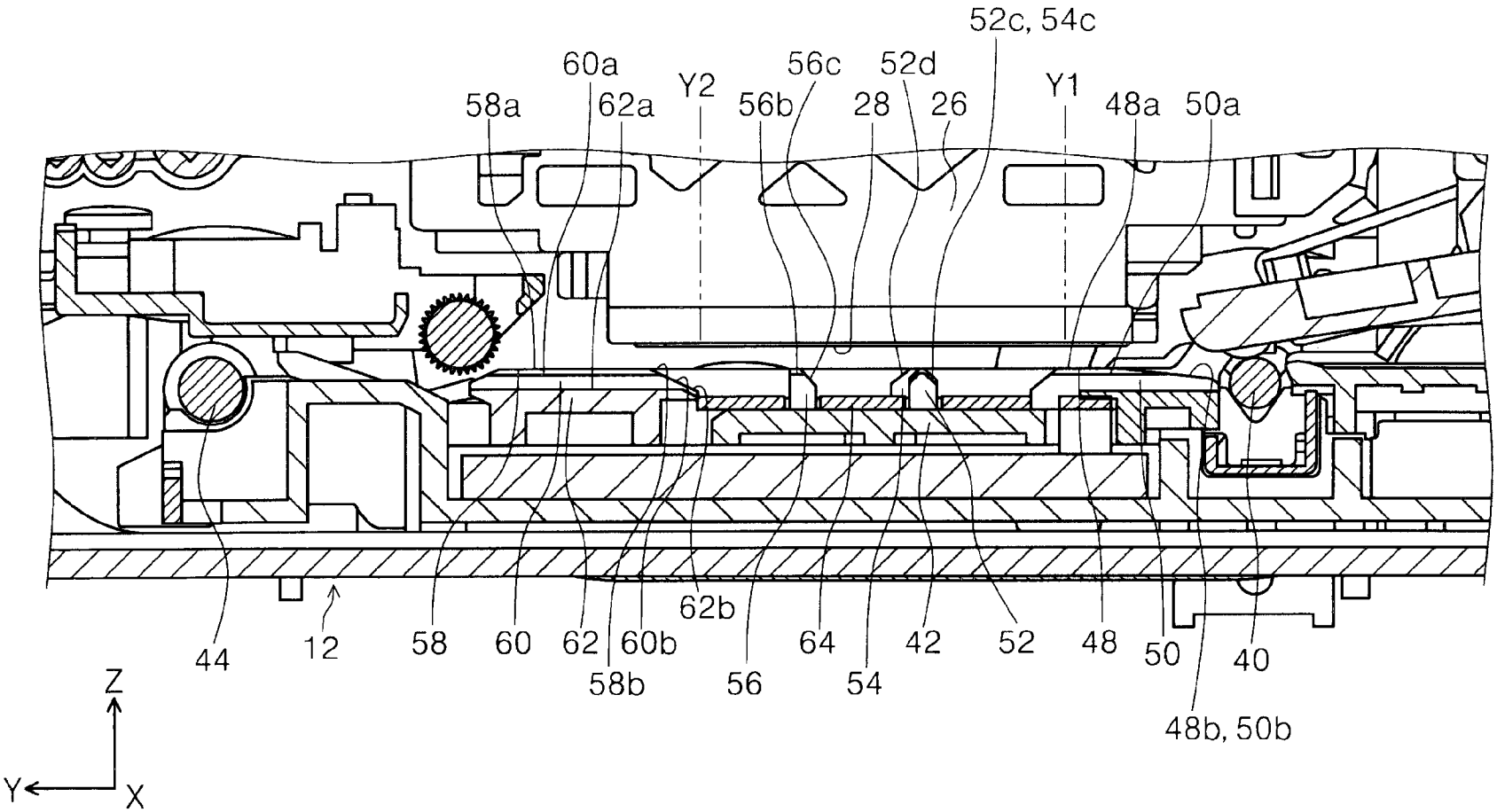
FIG. 4 is a side sectional view showing a recording head and a support member in the printer according to the invention.

FIG. 1 is an external perspective view of a printer according to the invention. FIG. 2 is a perspective view of an apparatus main body according to the invention. FIG. 3 is a side sectional view showing a medium transport path of the printer according to the invention. FIG. 4 is a side sectional view showing a recording head and a support member in the printer according to the invention.

Figure 5:
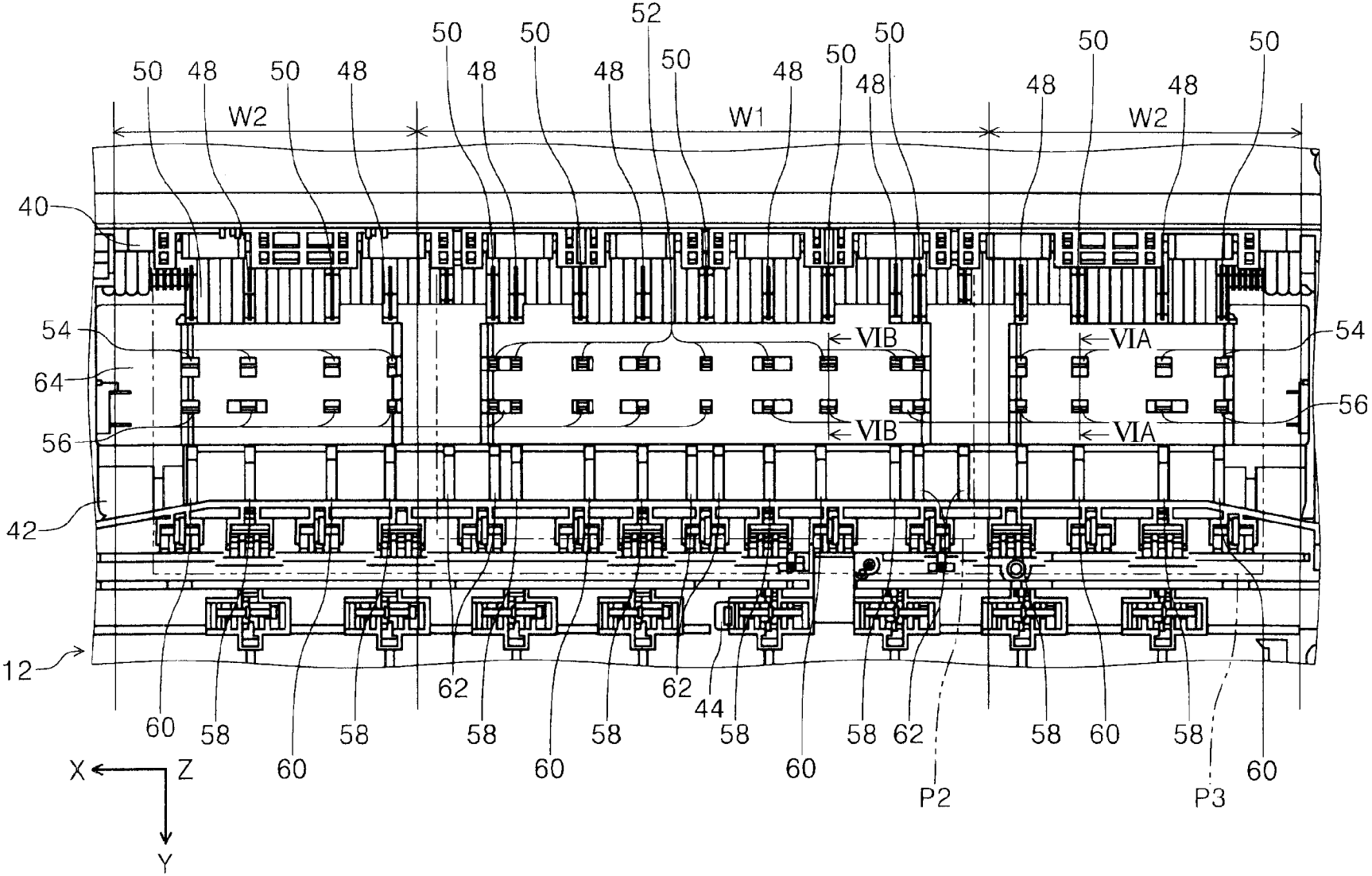
FIG. 5 is a plan view of the support member as viewed from above.
Figure 6A:
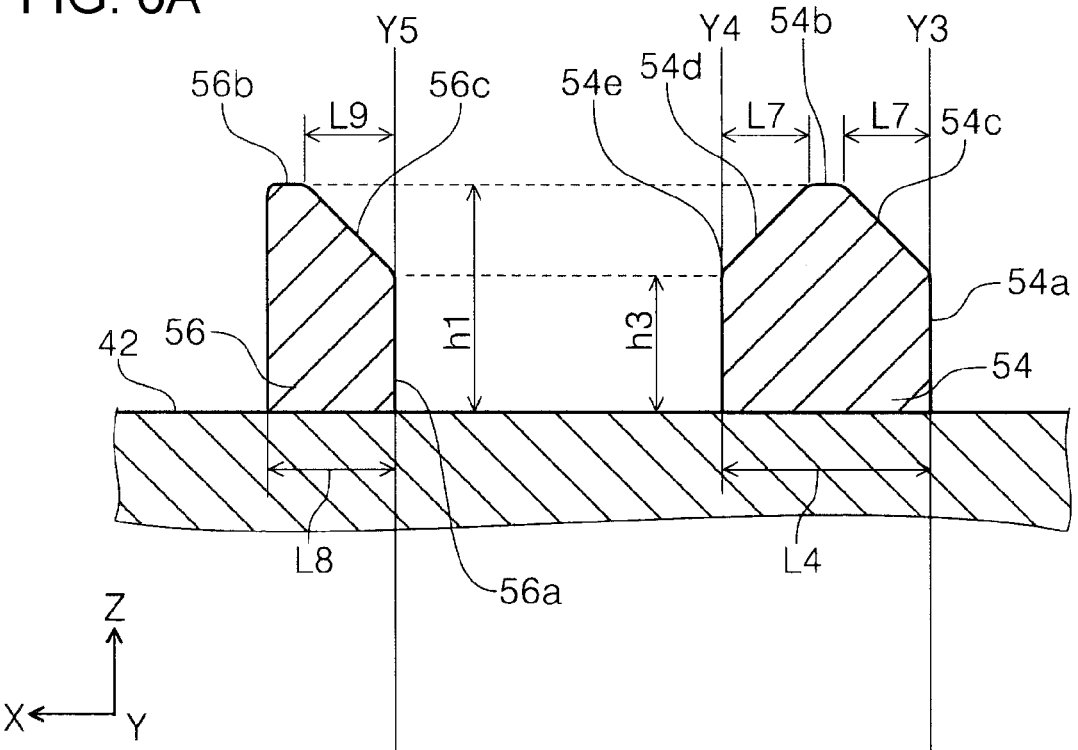
FIG. 6A is a sectional view taken along sectional line VIA-VIA in FIG. 5.
Figure 6B:
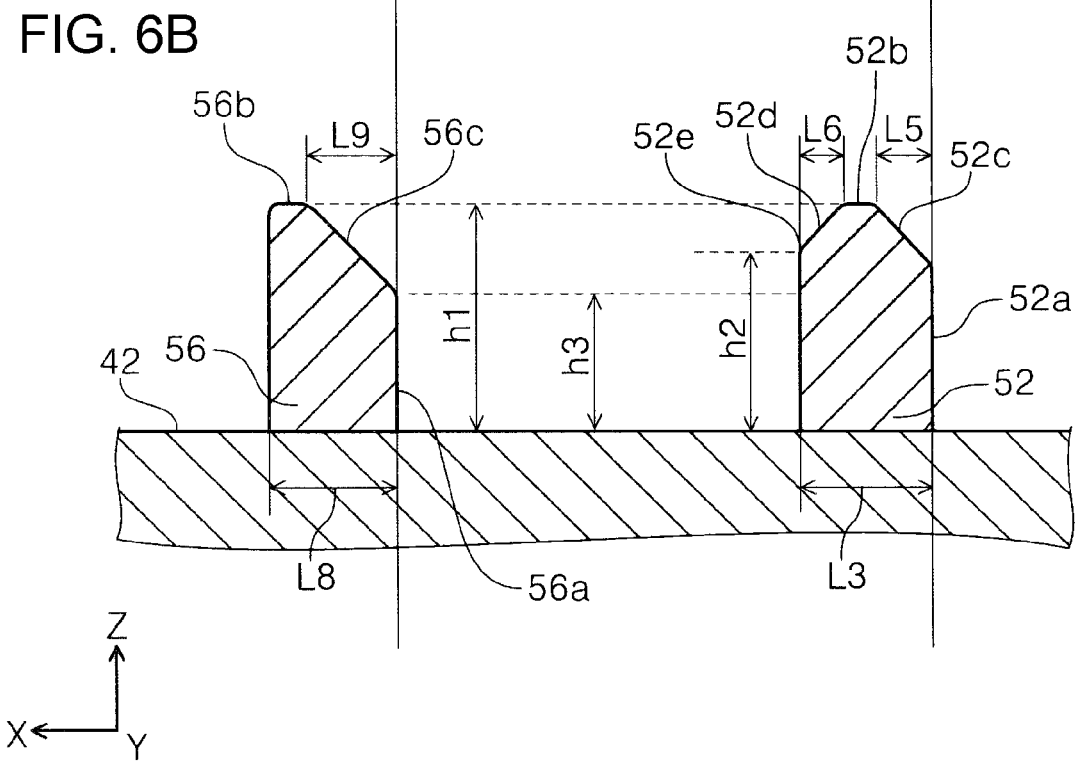
FIG. 6B is a sectional view taken along sectional line VIB-VIB in FIG. 5.
Figure 7:
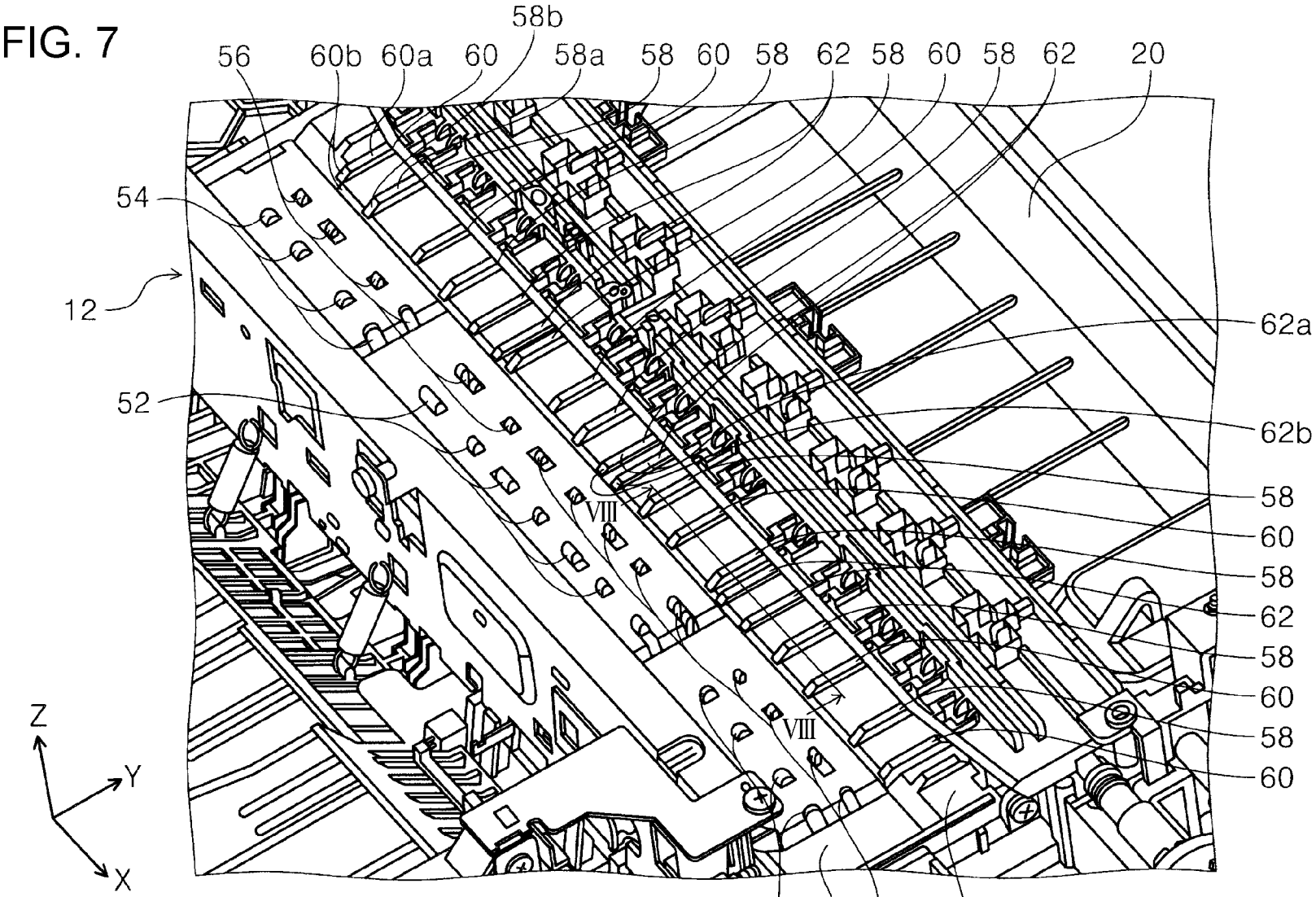
FIG. 7 is a perspective view of the support member.
Figure 8:
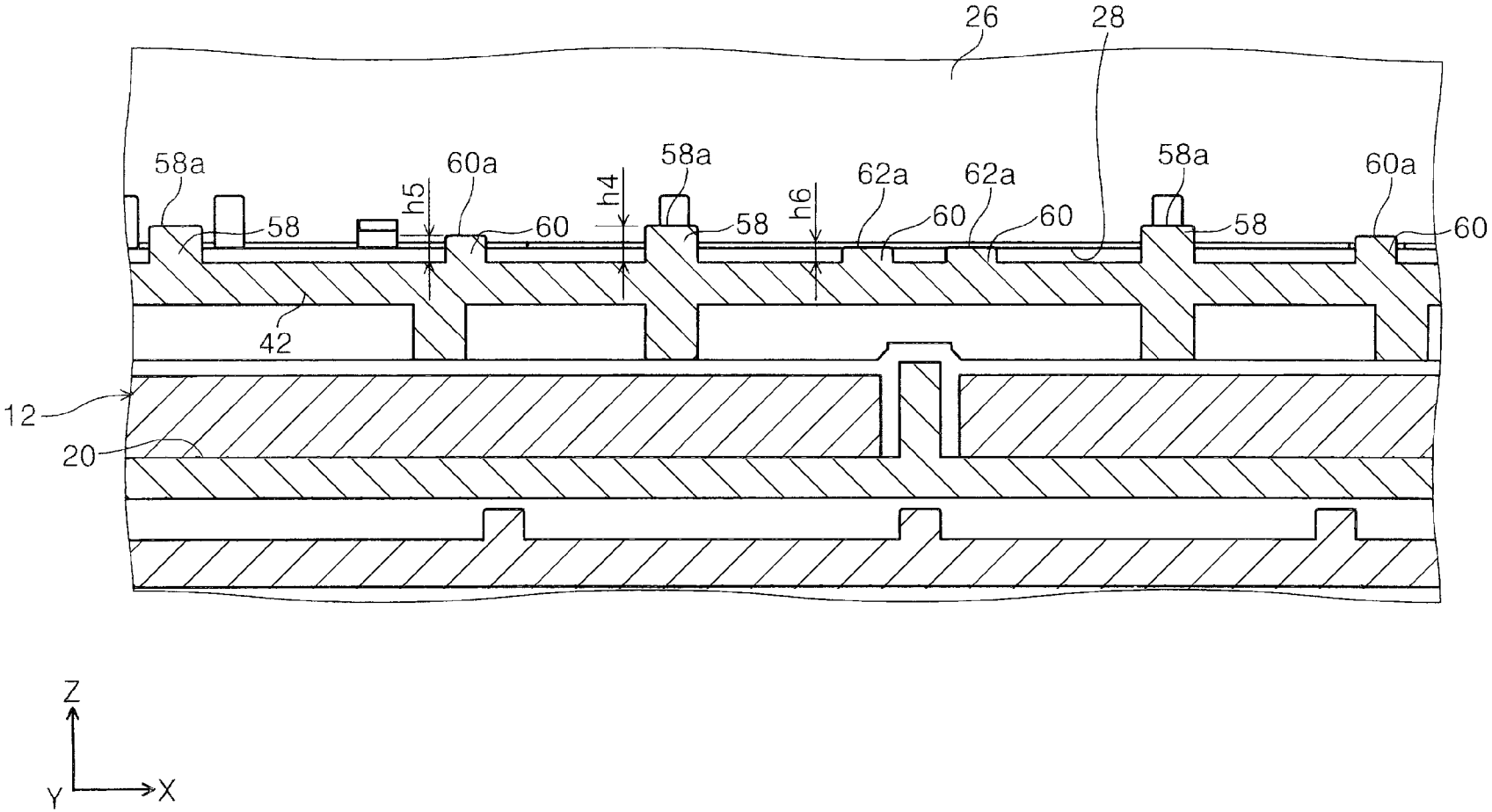
FIG. 8 is a sectional view taken along a sectional line VIII-VIII in FIG. 7.

FIG. 5 is a plan view of the support member as viewed from above. FIG. 6A is a sectional view taken along sectional line VIA-VIA in FIG. 5, and FIG. 6B is a sectional view taken along sectional line VIB-VIB in FIG. 5. FIG. 7 is a perspective view of the support member. FIG. 8 is a sectional view taken along a sectional line VIII-VIII in FIG. 7.

Figure 9:
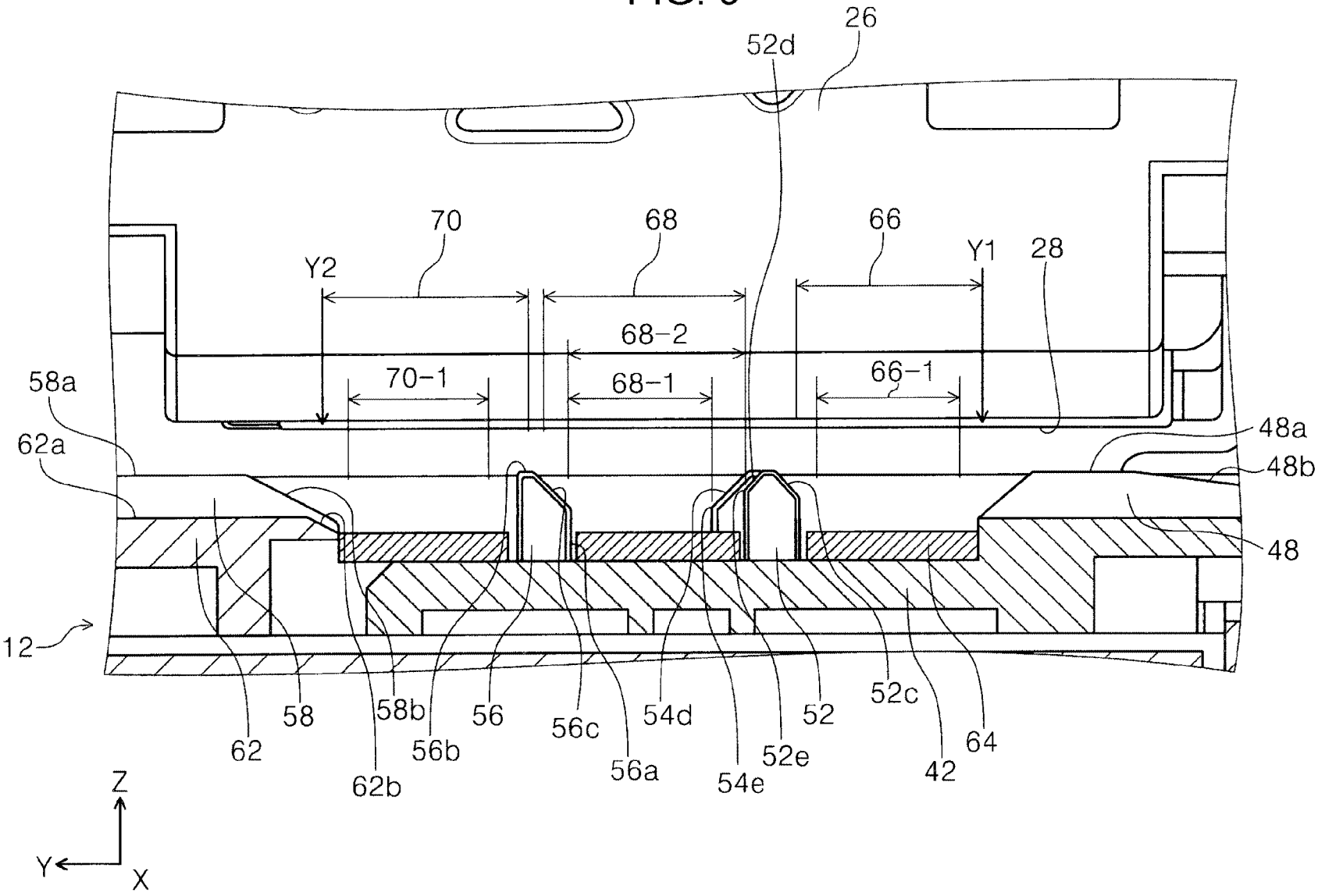
FIG. 9 is a side sectional view showing a relationship between ink ejection regions of the recording head and ribs of the support member.
Figure 10:
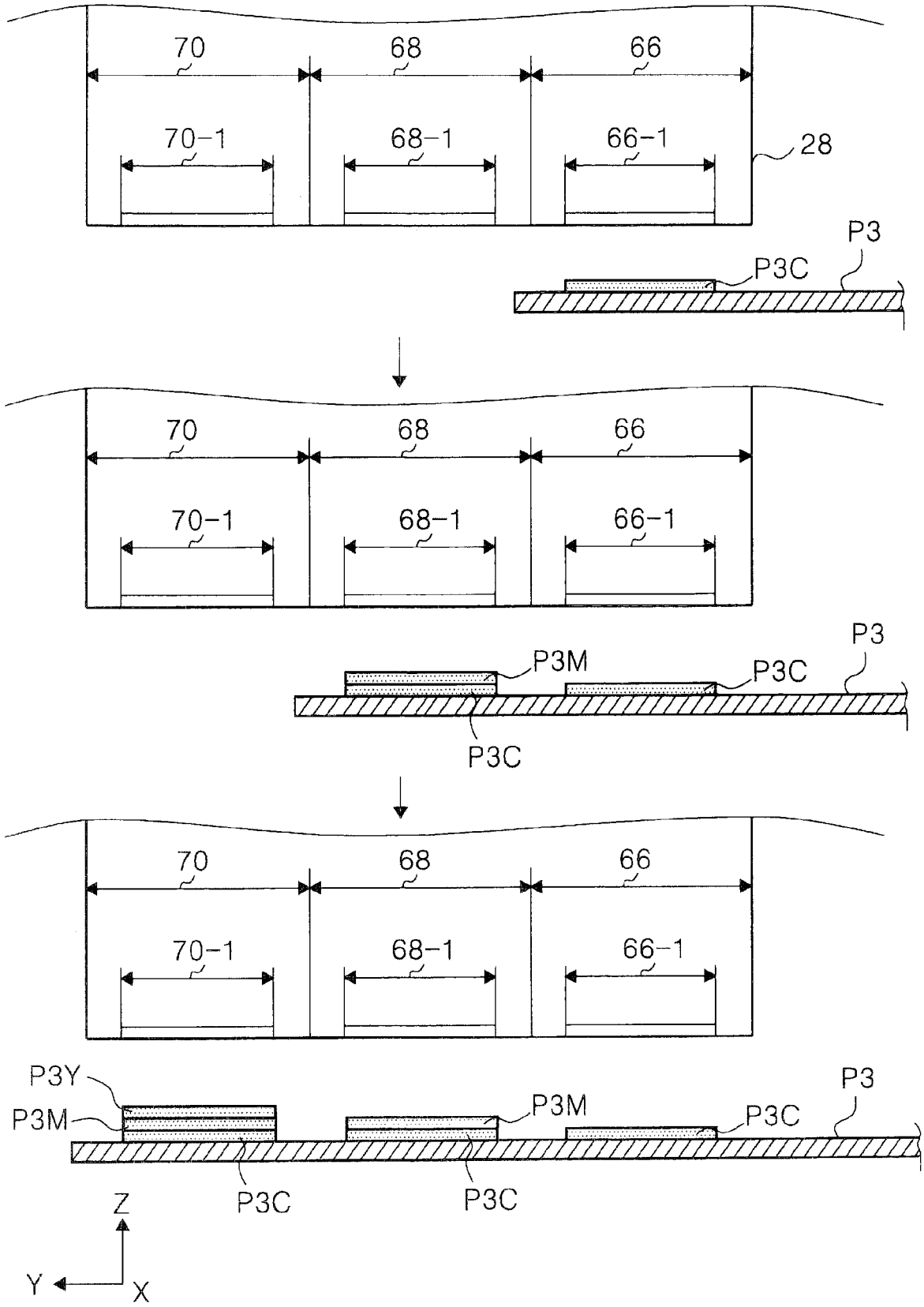
FIG. 10 is a schematic diagram for describing a first recording mode in the recording head.
Figure 11:
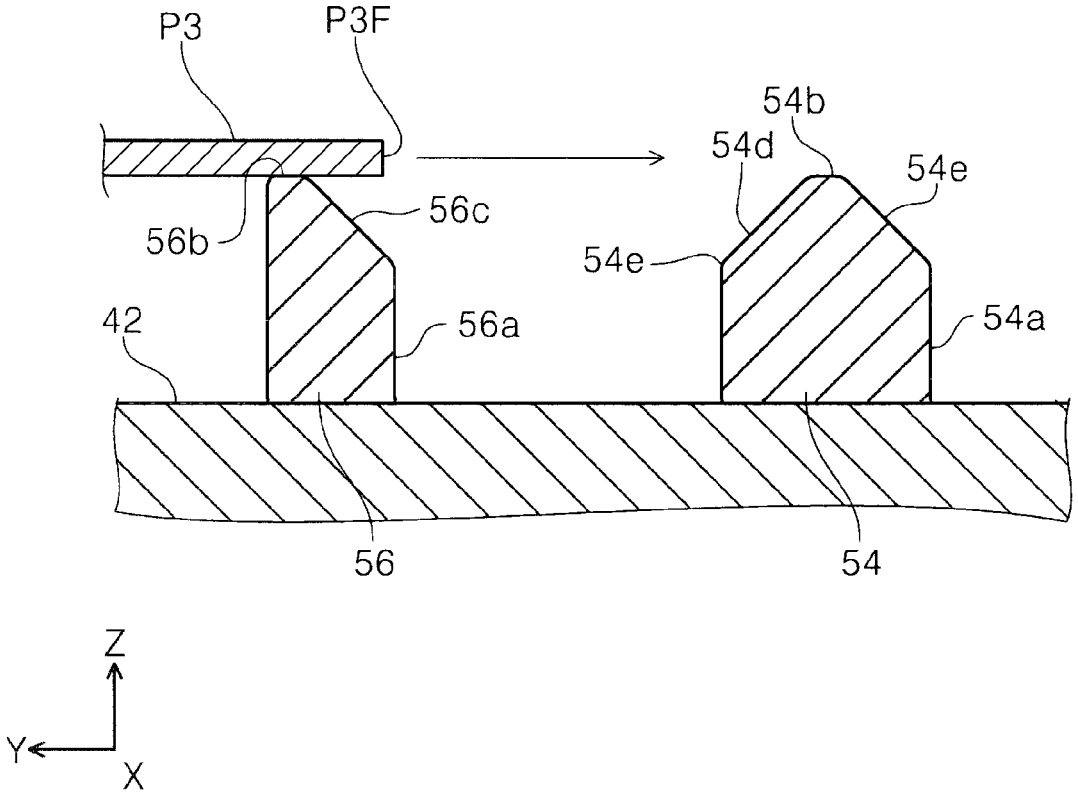
FIG. 11 is a side view showing a relationship between a trailing edge of a medium and third ribs at the time of performing a both-surface recording.
Figure 12:
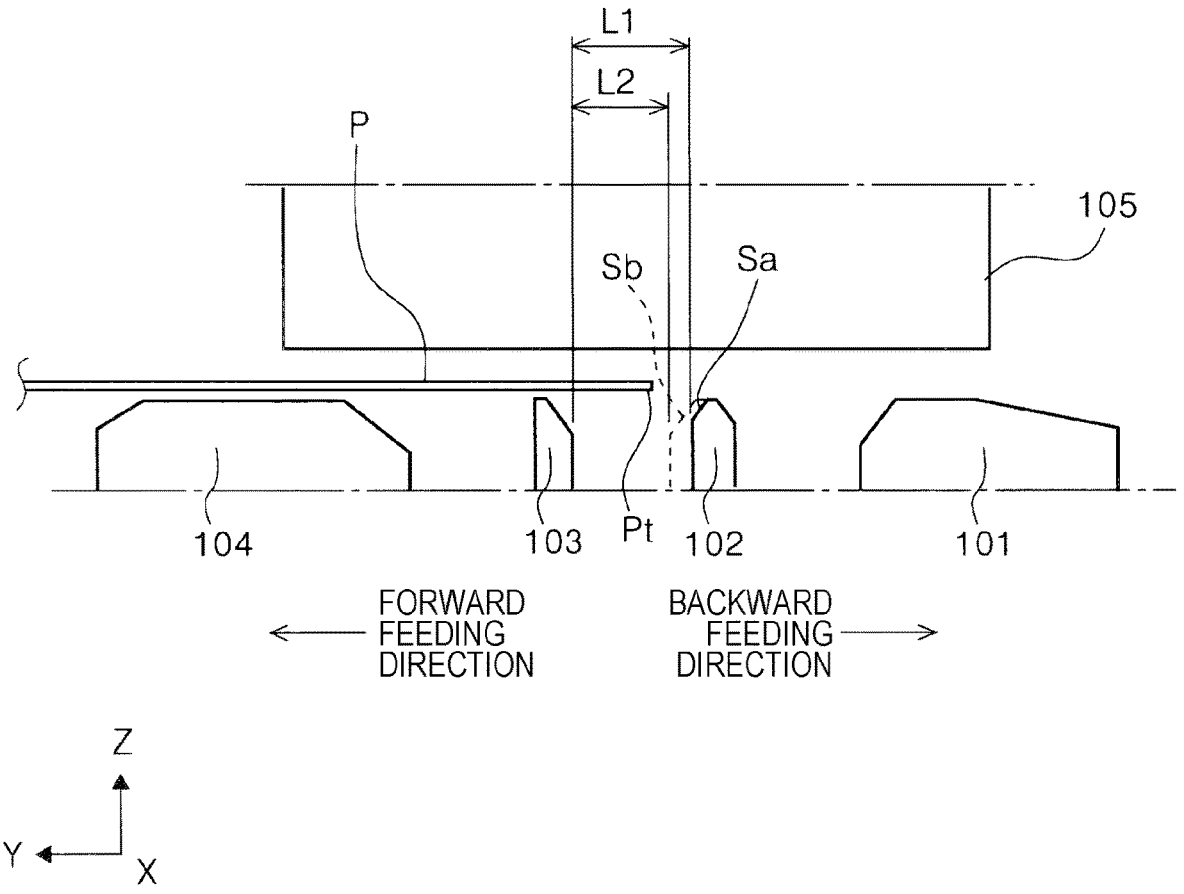
FIG. 12 is a schematic diagram for describing the technical problem of the invention.

FIG. 9 is a side sectional view showing a relationship between ink ejection regions of the recording head and ribs of the support member. FIG. 10 is a schematic diagram for describing a first recording mode in the recording head. FIG. 11 is a side view showing a relationship between a trailing edge of a medium and third ribs at the time of performing a both-surface recording. FIG. 12 is a schematic diagram for describing the technical problem of the invention.

Further, in an XYZ coordinate system shown in each drawing, an X direction indicates a width direction of the medium, that is, an apparatus width direction, a Y direction indicates a transport direction of the medium in a transport path in the recording apparatus, that is, an apparatus depth direction, and a Z direction indicates an apparatus height direction.

Examples

Outline of Printer

Referring to FIG. 1, an overall configuration of a printer 10 is described. The printer 10, which is an example of the recording apparatus, is configured as an ink jet printer. The printer 10 is configured as a multifunction machine including an apparatus main body 12 and a scanner unit 14. The scanner unit 14 includes a scanner main body 14*a* and an auto document feeder (ADF) 14*b*.

On a front side of the apparatus main body 12, an operating section 16 and a discharge port 18 are provided, and below the discharge port 18, a medium receiving tray 20 is provided. Below the medium receiving tray 20, a medium storage cassette 22, which can be inserted into the apparatus main body 12 from the front side thereof and removed therefrom, is provided.

Referring to FIG. 2, in the front side of the apparatus main body 12, on a −X axis direction side of the medium storage cassette 22, an ink storage section 24 is provided. In the ink storage section 24, a plurality of ink tanks are disposed. In the respective ink tanks, as an example, black ink, magenta ink, yellow ink, and cyan ink are respectively stored.

On a −Y direction side (a back side of the apparatus) of the ink storage section 24 in the Y axis direction (apparatus depth direction) of the apparatus main body 12, a carriage 26 movable in the X axis direction is provided. Under the carriage 26, a recording head 28 (FIG. 3) to be described later is provided. An ink tube 30 extends from each of the ink tanks in the ink storage section 24. The ink tube 30 extends in the +X axis direction, then changes its direction by making an upward curve, extends in the −X axis direction, and is guided into the carriage 26. In the lower surface of the recording head 28, a plurality of ink ejection nozzles are provided and are configured to be capable of ejecting ink supplied via the ink tube 30 from each of the ink tanks in the ink storage section 24.

Regarding Medium Transport Path

Referring to FIGS. 3 and 4, the medium transport path of the printer 10 will be described. In the −Y direction side of the apparatus main body 12, above the medium storage cassette 22, a pick-up roller 32 is disposed. The pick-up roller 32 is configured to be rotatable about a rotating shaft 34 as a support point. The pick-up roller 32 contacts the medium stored in the medium storage cassette 22, thereby transporting the uppermost medium of the media stored in the medium storage cassette 22 to a transport direction-downstream side along the medium transport path. Referring to FIG. 3, a dash-single dotted line designated by reference numeral P1 indicates a path of the medium which is sent out from the medium storage cassette 22 to the transport direction-downstream side in the apparatus main body 12.

On a downstream side of the pick-up roller 32 in the medium transport direction, a feed roller 36 is provided. Around the feed roller 36, driven rollers 38*a*, 38*b*, 38*c*, and 38*d* are provided so that each of the driven rollers 38*a*, 38*b*, 38*c*, and 38*d* can be driven to rotate with respect to the feed roller 36. The medium sent by the pick-up roller 32 is sent, via the feed roller 36 and the driven rollers 38*a*, 38*b*, and 38*c*, to a transport roller 40 as "upstream side transport unit" disposed on the transport direction-upstream side.

On a downstream side of the transport roller 40 in the medium transport direction, the carriage 26 and the recording head 28 are provided. Below the recording head 28, a support member 42 (FIG. 4) which faces the recording head 28 and supports the medium is provided. By supporting the medium from below, the support member 42 defines the distance (gap) between a recording surface of the medium and a head surface of the recording head 28.

As shown in FIG. 4, in the Y-axis direction, a dash-double dotted line designated by a reference numeral Y1 indicates a nozzle position which is the transport direction-most upstream in the recording head 28, and a dash-double dotted line designated by a reference numeral Y2 indicates a nozzle position which is the transport direction-most downstream in the recording head 28. When the medium supported by the support member 42 faces a region from Y1 to Y2 of the recording head 28 in the medium transport direction, ink is ejected toward the medium from a plurality of nozzle holes in the recording head 28 and the ink lands on a recording surface (a surface facing the recording head 28) of the medium, thereby executing recording. A configuration of a nozzle surface in the recording head 28 will be described later.

The medium on which recording has been executed by the recording head 28 is discharged to the medium receiving tray 20 through the discharge port 18 by a discharge roller 44 as "downstream side transport unit" disposed on the medium transport direction-downstream side with respect to the recording head 28.

Referring back to FIG. 3, in the apparatus main body 12, a control section 46 as "control unit" is provided. In this example, the control section 46 is, as an example, configured as an electric circuit having a plurality of electronic components. The control section 46 is, as an example, configured not only to control rotational drive of the pick-up roller 32, the feed roller 36, the transport roller 40, and the discharge roller 44, but also to control movement of the carriage 26 in the X axis direction, ink ejection operation of the recording head 28, and the like.

Regarding Configuration of Support Member

Referring to FIGS. 4 to 8, a configuration of the support member 42 will be described. Referring to FIGS. 4 and 5, the support member 42 is disposed between the transport roller 40 and the discharge roller 44 in the transport direction. As shown in FIG. 5, the support member 42 extends in the X axis direction. On the upper surface of the support member 42, a plurality of rib rows are provided while being spaced apart from one another at an appropriate interval from the transport direction-upstream side toward the transport direction-downstream side and protruding from the upper surface toward the recording head 28 side (upward). Specifically, on the transport direction-most upstream of the upper surface of the support member 42, the first ribs 48 and 50 are formed while being spaced apart from one another at an appropriate interval in the X axis direction (medium width direction) that is a direction intersecting with the transport direction (Y axis direction).

On the transport direction-downstream side of the first ribs 48 and 50, a plurality of second ribs 52 and 54 are provided while being spaced apart from one another at an appropriate interval in the X axis direction. On the transport direction-downstream side of the second ribs 52 and 54, a plurality of third ribs 56 are provided while being spaced apart from one another at an appropriate interval in the X axis direction. On the transport direction-downstream side of the third ribs 56, a plurality of fourth ribs 58, 60 and 62 are provided while being spaced apart from one another at an appropriate interval in the X axis direction.

Furthermore, on the upper surface of the support member 42, as an example, an ink absorbing member 64 formed of a sponge or the like is disposed. In this example, the ink absorbing member 64 is provided with an opening in response to a formation position of each rib. In a case where the ink absorbing member 64 is disposed on the support member 42, each rib is configured to protrude upward from the opening.

In this example, the first rib 48 and the first rib 50 are configured so that the amount of protrusion from the support member 42 is different from each other. Specifically, as shown in FIG. 4, a configuration in which an upper surface 48*a* of the first rib 48 is positioned above an upper surface 50*a* of the first rib 50 can be employed. In this example, the first rib 48 and the first rib 50 are, as an example, disposed substantially alternately in the medium width direction (FIG. 5). In this example, the transport roller 40 transports the medium so that the medium is pressed against the first ribs 48 and 50 provided on the support member 42. Accordingly, a mountain and a valley are formed on the medium in the medium width direction by the first rib 48 having a tall height and the first rib 50 having a low height. Thus, when the medium passes over the first ribs 48 and 50, a corrugation shape (cockling) is easily formed on the medium.

Referring to FIGS. 4 and 9, on the transport direction-upstream side end portions of the first ribs 48 and 50, upstream guide surfaces 48*b* and 50*b* are respectively formed. In this example, the upstream guide surfaces 48*b* and 50*b* (FIG. 4) are configured as uphill slopes extending from the transport direction-upstream side toward the transport direction-downstream side, and are connected to the upper surfaces 48*a* and 50*a*, respectively.

Referring to FIG. 5, a region designated by a reference numeral W1 indicates a first region W1 in the medium width direction, and a region designated by a reference numeral W2 indicates a second region W2 which is disposed outside the first region W1 in the medium width direction. Here, a dash-double dotted line designated by a reference numeral P2 indicates a medium of which a width is smaller than a width of the first region W1 and of which a transport region in the medium width direction is positioned within the first region W1. In this example, the medium designated by the reference numeral P2 indicates, as an example, a paper size of 4×6. In addition to this, as a paper size for a medium that uses the first region W1 as a medium transport region, an A6 size, a postcard size, and the like can be mentioned.

On the other hand, a dash-double dotted line designated by a reference numeral P3 indicates a medium of which a width is larger than the width of the first region W1 and of which a transport region in the medium width direction is positioned within a second region W2 beyond the first region W1. In this example, the medium designated by the reference numeral P3 indicates, as an example, a paper size of A4. In addition to this, as a paper size for a medium that uses the first region W1 and the second region W2 as the medium transport region, a letter size and the like can be mentioned.

Referring to FIG. 5, in the first region W1, the second ribs 52 are disposed, and in the second region W2, the second ribs 54 are disposed. Referring to FIGS. 6A and 6B, configurations of the second ribs 52 and 54, and the third rib 56 will be described.

As shown in FIGS. 6A and 6B, a position of a transport direction-upstream side end portion 52*a* of the second rib 52 provided in the first region W1 and a position of a transport direction-upstream side end portion 54*a* of the second rib 54 provided in the second region W2 are positioned at a position that is Y3 in the medium transport direction, and the respective positions in the transport direction match with each other. "Positions match with each other" means that the positions are not only completely identical but also have errors occurring upon forming the second ribs 52 and 54 in the support member 42, and the like.

In this example, a length of the second rib 52 in the transport direction is set to L3. On the other hand, a length of the second rib 54 in the transport direction is set to L4. In this example, the length L4 is set to be longer than the length L3. Furthermore, a height position for an upper surface 52*b* of the second rib 52 and an upper surface 54*b* of the second rib 54 with respect to the support member 42 is set to a height h1.

As shown in the sectional view (VIB-VIB), in the second rib 52, with respect to the medium transport direction, an upstream guide surface 52*c* is formed on the transport direction-upstream side, and a first guide surface 52*d* is formed on the transport direction-downstream side. In this example, the upstream guide surface 52*c* is configured as an uphill slope while extending from the upstream side end portion 52*a* toward the transport direction-downstream side. A length of the guide surface 52*c* in the transport direction is set to L5. In this example, the upstream guide surface 52*c* is configured as a guide surface for scooping up the leading edge of the medium which is transported from the upstream side toward the downstream side in the medium transport direction.

The first guide surface 52*d* is configured as a downhill slope while extending from the upper surface 52*b* toward the transport direction-downstream side. A length of the first guide surface 52*d* in the transport direction is set to L6. In this example, the length L5 of the upstream guide surface 52*c* in the transport direction is set to be longer than the length L6 of the first guide surface 52*d* in the transport direction. Furthermore, in this example, a height position for a downstream side end portion 52*e* of the first guide surface 52*d* is set to a height h2 with respect to the support member 42.

Next, as shown in the sectional view (VIA-VIA), in the second rib 54, with respect to the medium transport direction, an upstream guide surface 54*c* is formed on the transport direction-upstream side, and a second guide surface 54*d* is formed on the transport direction-downstream side. In this example, the upstream guide surface 54*c* is configured as an uphill slope while extending from the upstream side end portion 54*a* toward the transport direction-downstream side. A length of the upstream guide surface 54*c* in the transport direction is set to L7. In this example, the upstream guide surface 54*c* is also configured as a guide surface for scooping up the leading edge of the medium which is transported from the upstream side toward the downstream side in the medium transport direction. In this example, the length L7 is set to be longer than the length L5 or the length L6.

The second guide surface 54*d* is configured as a downhill slope while extending from the upper surface 54*b* toward the transport direction-downstream side. A length of the second guide surface 54*d* in the transport direction is set to L7. Furthermore, in this example, a height position for a downstream side end portion 54*e* of the second guide surface 54*d* is set to a height h3 that is lower than the height h2.

In this example, a position of the transport direction-downstream side end portion 54*e* of the second guide surface 54*d* of the second rib 54 in the transport direction is positioned at a position Y4 of the transport direction-downstream side which is positioned downstream from the position Y3 by the length L4. That is, the transport direction-downstream side end portion 54*e* of the second guide surface 54*d* in the medium transport direction is positioned on a downstream side from the transport direction-downstream side end portion 52*e* of the first guide surface 52*d*. Furthermore, the height position h3 for the transport direction-downstream side end portion 54*e* of the second guide surface 54*d* with respect to the support member 42 is set to be lower than the height position h2 for the transport direction-downstream side end portion 52*e* of the first guide surface 52*d*.

As shown in the sectional views (VIA-VIA) and (VIB-VIB), the third rib 56 is disposed so that an upstream side end portion 56*a* thereof is positioned at a position Y5 which is on a downstream side of each of the second ribs 52 and 54 in the medium transport direction. In this example, a length of the third rib 56 in the transport direction is set to L8. An upper surface 56*b* of the third rib 56 is also set to a height h1 similarly to the height position for the upper surface 52*b* of the second rib 52 and the upper surface 54*b* of the second rib 54.

In the third rib 56, on the transport direction-upstream side in the medium transport direction, an upstream guide surface 56*c* is formed. In this example, the upstream guide surface 56*c* is configured as an uphill slope while extending from the upstream side end portion 56*a* toward the transport direction-downstream side. A length of the upstream guide surface 56*c* in the transport direction is set to L9. In this example, as an example, the length L9 is set to the same length as the length L3 of the second rib 52. However, the length L9 may be changed as appropriate.

Here, referring back to FIG. 5, the medium P2 which is transported using only the first region W1 is a medium having a relatively small size such as an L-type photograph size, for which a dedicated paper having a high paper stiffness (rigidity) is often used. On the other hand, the medium P3 which is transported using the first region W1 and the second region W2 is, for example, a medium having a relatively large size such as an A4 size, for which a plain paper having a low paper stiffness (rigidity) is used. As an example, in a case of the plain paper having a low paper stiffness (rigidity), the amount of hanging-down at the medium leading edge is greater than the amount of hanging-down at the leading edge of the dedicated paper having a high paper stiffness (rigidity).

In this example, the upstream guide surface 54*c* and the second guide surface 54*d* of the second rib 54 disposed in the second region W2 outside the first region W1 are set so that each guide surface has a long length in the transport direction and also has a large guiding amount (amount of variation in a height direction of the guide surface), compared to the upstream guide surface 52*c* and the first guide surface 52*d* of the second rib 52 disposed in the first region W1. Accordingly, in the medium P3 having a low paper stiffness (rigidity), the leading edge (edge portion that becomes a head side in the transport direction) of the medium can be prevented from getting caught in the rib at the time of being fed forward (transported from the upstream side to the downstream side in the transport direction) and of being fed backward (transported from the downstream side to the upstream side in the transport direction).

Furthermore, in this example, the first guide surface 52*d* is provided even in the second rib 52 corresponding to the medium P2 that is a dedicated paper having as a high paper stiffness (rigidity). Thus, the leading edge of the medium P2 can be prevented from getting caught in the second rib 52 at the time of being fed backward (transported from the downstream side to the upstream side in the transport direction).

Referring to FIGS. 7 and 8, fourth ribs 58, 60, and 62 will be described. The fourth ribs 58, 60, and 62 are disposed on a downstream side of the third rib 56 in the transport direction. As an example, the fourth ribs 58, 60, and 62 are configured so that each of the upper surfaces 58*a*, 60*a*, and 62*a* has a different height position with respect to the support member 42. Referring to FIG. 8, the height position for the upper surface 58*a* of the fourth rib 58 is set to a height h4 with respect to the support member 42, the height position for the upper surface 60*a* of the fourth rib 60 is set to a height h5 with respect to the support member 42, and the height position for the upper surface 62*a* of the fourth rib 62 is set to a height h6 with respect to the support member 42. Here, the respective heights in this example are set to have a relationship of h4>h5>h6.

In this example, the height h6 for the fourth rib 62 is set to be the lowest. In a case where the height of the fourth rib 62 at a position where the fourth rib 62 is provided in the medium width direction is set to be lower than the heights h4 and h5 of other ribs 58 and 60, for example, when a thin medium having a large width in the medium width direction is transported from the upstream side toward the downstream side in the transport direction, it is possible to prevent the leading edge of the medium from colliding with the fourth rib 62. As a result, it is possible to stabilize a medium transport and to reduce printing defects in the recording head 28.

In this example, as an example, as shown in FIG. 5, the fourth ribs 58, 60, and 62 are provided, respectively, in the medium width direction at positions corresponding to the positions where the first ribs 48 and 50 are provided. In particular, the fourth rib 58 having the highest height in the height direction is provided at a position corresponding to the first rib 48 having a tall height in the medium width direction.

Furthermore, on the transport direction-upstream side end portions of the respective ribs 58, 60, and 62, upstream guide surfaces 58*b*, 60*b*, and 62*b* (FIG. 4) are formed, respectively. In this example, the upstream guide surfaces 58*b*, 60*b*, and 62*b* are configured as uphill slopes extending from the transport direction-upstream side toward the transport direction-downstream side, and are connected to the upper surfaces 58*a*, 60*a*, and 62*a* (FIG. 9), respectively.

Regarding Configuration of Recording Head

Referring to FIG. 9, in the lower surface of the recording head 28, a plurality of ink nozzles capable of ejecting ink are formed. More specifically, in a region from the position Y1 to the position Y2 in the medium transport direction, three nozzle groups 66, 68, and 70 are formed. In this example, a region designated by the reference numeral 66 in the medium transport direction is a first nozzle group 66. The first nozzle group 66 faces a region between the first ribs 48 and 50 and the second ribs 52 and 54 in the medium transport direction, and includes a plurality of ink ejection nozzles capable of ejecting ink toward the region between the first ribs 48 and 50 and the second ribs 52 and 54. As an example, the ink ejection nozzles of the first nozzle group 66 are configured to eject cyan ink.

In this example, a region designated by the reference numeral 68 in the medium transport direction is a second nozzle group 68. The second nozzle group 68 faces a region between the second ribs 52 and the third ribs 56 in the medium transport direction, and includes a plurality of ink ejection nozzles capable of ejecting ink toward the region between the second ribs 52 and the third ribs 56. As an example, the ink ejection nozzles of the second nozzle group 68 are configured to eject magenta ink.

Some ink ejection nozzles positioned on the transport direction-upstream side in the second nozzle group 68 are provided at a position facing the second guide surface 54*d* of the second rib 54 in the medium transport direction. Some ink ejection nozzles positioned on the transport direction-downstream side in the second nozzle group 68 are provided at a position facing the upstream guide surface 56*c* of the third rib 56 in the medium transport direction.

In this example, a region designated by the reference numeral 70 in the medium transport direction is a third nozzle group 70. The third nozzle group 70 faces a region between the third ribs 56 and the fourth ribs 58, 60, and 62 in the medium transport direction, and includes a plurality of ink ejection nozzles capable of ejecting ink toward the region between the third ribs 56 and the fourth ribs 58, 60, and 62. As an example, the ink ejection nozzles of the third nozzle group 70 are configured to eject yellow ink. Some ink ejection nozzles positioned on the transport direction-upstream side in the third nozzle group 70 are provided at a position facing the upper surface 56*b* of the third rib 56 in the medium transport direction.

Furthermore, although not shown, in the lower surface of the recording head 28, a plurality of ink ejection nozzles are arranged from the position Y1 toward the position Y2 in the medium transport direction, and the ink ejection nozzles are configured to eject black ink.

Regarding First Recording Mode and Second Recording Mode

In this example, the first recording mode and the second recording mode are recording modes used at the time of executing so-called a borderless printing in which recording is performed without leaving any margin in a medium for which recording is performed. In a case where the borderless printing is selected in recording operation on the medium, the control section 46 determines whether the edge portions of the medium in the medium width direction on which recording is performed are positioned within the first region W1 or exceeds the first region W1, on the basis of input information from the operating section 16, driver information, information from an external device, such as a PC, connected to the printer 10, and the like. The control section 46 selects the first recording mode in a case where the edge portions of the medium in the medium width direction are positioned outside the first region W1, for example in a case of the medium P3 (FIG. 5), and selects the second recording mode in a case where the edge portions of the medium in the medium width direction are positioned inside the first region W1, for example in a case of the medium P2 (FIG. 5).

First, the first recording mode will be described. In the first recording mode, restrictions are imposed so that among the plurality of ink ejection nozzles provided in the second nozzle group 68, only the ink ejection nozzles provided in a region designated by a reference numeral 68-1 eject inks, thereby executing recording operation. Specifically, the ink ejection region 68-1 faces a region between the transport direction-downstream side end portion 54*e* of the second rib 54 and the upstream side end portion 56*a* of the third rib 56 in the medium transport direction. The plurality of ink ejection nozzles provided on the ink ejection region 68-1 eject inks on the region between the transport direction-downstream side end portion 54*e* of the second rib 54 and the upstream side end portion 56*a* of the third rib 56.

Here, in a case where ejection restrictions are not imposed on the second nozzle group 68 at the time of executing the borderless printing, when the trailing edge of the medium passes over the second rib 54, some of the ink ejected toward the trailing edge of the medium may be adhered to the second guide surface 54*d* and the like of the second rib 54. In a case where a subsequent medium passes over the second rib 54 which is in a state where ejected ink is adhered, a back surface (a surface which is opposite a surface facing the recording head) of the subsequent medium may be stained with the ink adhered to the second rib 54, thereby deteriorating a quality of the medium.

In this example, at the time of executing the borderless printing, by restricting an ink ejection region of the second nozzle group 68 to a region between the second rib 54 and the third rib 56 in the medium transport direction, it is possible to reduce adherence of ink to the second rib 54. Accordingly, even at the time of executing the borderless printing on the medium of which positions of the edge portions in the medium width direction are positioned outside the first region, for example the medium P3 (FIG. 5), it is possible to reduce a possibility that a back surface of the medium P3 is stained with ink.

Furthermore, in this example, at the time of executing the first recording mode, even in the first nozzle group 66 and the third nozzle group 70, an ink ejection region in the medium transport direction is restricted by control of the control section 46. Specifically, in the first nozzle group 66, the ink ejection region in the medium transport direction is restricted to a region designated by the reference numeral 66-1. Similarly, in the third nozzle group 70, the ink ejection region in the medium transport direction is restricted to a region designated by the reference numeral 70-1.

In this example, a length of the ink ejection region 66-1 or 70-1 in the medium transport direction corresponds to a length of the ink ejection region 68-1. More specifically, the number of ink ejection nozzles in the ink ejection region 66-1 or 70-1 matches the number of ink ejection nozzles in the ink ejection region 68-1.

Referring to FIG. 10, recording operation on the medium P3 in the first recording mode will be described. In an upper diagram of FIG. 10, when the medium P3 is transported from the transport direction-upstream side to a position facing the first nozzle group 66 of the recording head 28, cyan ink is ejected from the ink ejection region 66-1. In a middle diagram of FIG. 10, after receiving the ink ejected from the ink ejection region 66-1, the medium P3 is sent to the transport direction-downstream side. When a portion P3C of the medium P3 where the cyan ink is adhered is transported to a position facing the second nozzle group 68, magenta ink is ejected from the ink ejection region 68-1. Accordingly, the magenta ink is adhered on the cyan ink-adhered portion P3C of the medium P3.

Furthermore, in a lower diagram of FIG. 10, after receiving the ink ejected from the ink ejection region 68-1, the medium P3 is sent to the transport direction-downstream side. When a portion P3M of the medium P3 where the magenta ink is adhered on the cyan ink-adhered portion P3C is transported to a position facing the third nozzle group 70, yellow ink is ejected from the ink ejection region 70-1. Accordingly, a yellow ink-adhered portion P3Y of the medium P3 is formed by adherence of the yellow ink on the magenta ink-adhered portion P3M which is adhered on the cyan ink-adhered portion P3C.

In this example, the number of ink ejection nozzles in the ink ejection regions 66-1, 68-1, and 70-1 in the medium transport direction matches with one another. Thus, lengths of ink-adhered portions formed by adherence of inks on the medium P3 in the medium transport direction are substantially the same. As a result, at least cyan ink, magenta ink, and yellow ink are appropriately stacked on a region of the medium P3 where inks are adhered. Thus, an appropriate recording result is formed on the medium P3.

Referring back to FIG. 9, the second recording mode will be described. In the second recording mode, restrictions are imposed so that among the plurality of ink ejection nozzles provided in the second nozzle group 68, only the ink ejection nozzles provided in a region designated by a reference numeral 68-2 eject inks, thereby executing recording operation. Specifically, the ink ejection region 68-2 faces a region between the transport direction-downstream side end portion 52*e* of the second rib 52 and the upstream side end portion 56*a* of the third rib 56 in the medium transport direction. The plurality of ink ejection nozzles provided on the ink ejection region 68-2 eject inks on the region between the transport direction-downstream side end portion 52*e* of the second rib 52 and the upstream side end portion 56*a* of the third rib 56.

In the medium transport direction, a length of the ink ejection region 68-2 of the second nozzle group 68 in the second recording mode is longer than the ink ejection region 68-1 of the second nozzle group 68 in the first recording mode. Specifically, the ink ejection region 68-2 is longer than the ink ejection region 68-1 by only a length of L4 minus L3. Thus, the ink ejection region 68-2 has an increased number of the ink ejectable nozzles. As a result, in a case where a borderless printing is executed on the medium P2 of which the edge portions in the medium width direction are positioned within the first region W1, recording can be executed by inks ejected from a larger number of ink ejection nozzles, thereby preventing a recording throughput from being lowered.

Even in the second recording mode, similar to the first recording mode, ejection restrictions are imposed so that the length of the ink ejection region of the first nozzle group 66 or the third nozzle group 70 corresponds to the length of the ink ejection region 68-2 of the second nozzle group 68.

Control of Medium at Time of Performing Both-Surface Recording Operation

Next, referring to FIGS. 3, 4, and 11, control of the medium at the time of executing a both-surface recording operation will be described. Referring to FIGS. 3 and 4, when recording is executed on the first surface of the medium (surface that firstly faces the recording head at the time of being transported), the medium is sent out toward the driven roller 38*d*, which is positioned at a lower side of the feed roller 36, by reversely rotating the transport roller 40. The medium sent to the driven roller 38*d* is nipped by the feed roller 36 and the driven roller 38*d*, and is returned back to the transport roller 40 by the feed roller 36. At that time, the first surface of the medium (surface on which recording has been executed) and the second surface are reversed. Accordingly, recording is executed on the second surface in the recording head 28.

Here, as shown in FIG. 11, after recording has been executed on the first surface of the medium, the control section 46 stops the transport to the transport direction-downstream side (forward feeding), as an example, at a position where the trailing edge P3F of the medium P3 does not proceed to a downstream side from the third rib 56, specifically, in a state where the trailing edge P3F is supported on the upper surface 56*b* of the third rib 56. Thereafter, the control section 46 sends the medium P3 from the downstream side toward the upstream side in the medium transport direction (backward feeding) by reversely rotating the transport roller 40, in which the trailing edge P3F of the medium P3 becomes a head side.

In this example, the transport to the medium transport direction-downstream side (forward feeding) is stopped in a state where the trailing edge P3F of the medium P3 is supported on the third rib 56. Thus, compared to a case where the transport to the medium transport direction-downstream side (forward feeding) is stopped at a position where the trailing edge P3F of the medium P3 has climbed over the third rib 56, it is possible to reduce the ribs to be climbed over at the time of being fed backward and to reduce a risk of the trailing edge P3F getting caught in the rib. As a result, at the time of executing the both-surface recording operation on the medium in the printer 10, it is possible to prevent jamming from occurring.

To summarize the above description, the printer 10 includes a recording head 28 which performs recording on the medium; the support member 42 which is disposed to face the recording head 28 and on which a plurality of ribs 48, 50, 52, 54, 56, 58, 60, and 62 (FIG. 5) for supporting the medium are formed; the transport roller 40 provided on the upstream side of the support member 42 in the medium transport direction (Y axis direction); and the discharge roller 44 provided on the downstream side of the support member 42 in the medium transport direction. The plurality of ribs 48, 50, 52, 54, 56, 58, 60, and 62 include the plurality of first ribs 48 and 50 (FIGS. 4 and 5) which are spaced apart from one another at an appropriate interval in the medium width direction (X axis direction) that is a direction intersecting with the medium transport direction, and the plurality of second ribs 52 and 54 (FIG. 5 and FIG. 6) which are positioned on a downstream side from the first ribs 48 and 50 in the medium transport direction and are spaced apart from one another at an appropriate interval in the medium width direction. The second ribs 52 and 54 have the guide surfaces 52*d* and 54*d* (FIGS. 6A and 6B) for scooping up the leading edge of the medium which is fed backward from the downstream side to the upstream side in the medium transport direction, in which the guide surfaces 52*d* and 54*d* include the first guide surface 52*d* which is formed on each of the second ribs 52 positioned within the first region W1 (FIG. 5) in the medium width direction, and the second guide surface 54*d* which is formed on the second rib 54 positioned in the second region W2 positioned outside the first region W1 in the medium width direction. The medium transport direction-downstream side end portion 54*e* of the second guide surface 54*d* is positioned on a downstream side from the medium transport direction-downstream side end portion 52*e* of the first guide surface 52*d* and has a lower height position h3 than the height position h2 for the medium transport direction-downstream side end portion 52*e* of the first guide surface 52*d*.

The borderless recording, for example, tends to be performed more frequently for a medium having a relatively small size such as an L-type photograph size than a medium having a relatively large size such as an A4 size. Therefore, prioritizing a throughput of the borderless recording for a medium having a small size over a throughput of the borderless recording for a medium having a large size is in line with users' needs.

Further, regarding the medium having a small size such as an L-type photograph size, for which the borderless recording is performed at a high frequency as described above, a dedicated paper is often used. In this case, because of a high paper stiffness (rigidity), hanging-down at the leading edge hardly occurs, that is, getting-caught of the medium leading edge in the rib at the time of being fed backward hardly occurs.

On the contrary, regarding the medium having a relatively large size such as an A4 size, a plain paper is often used. In this case, because of a low paper stiffness (rigidity), hanging-down at the leading edge easily occurs, that is, getting-caught of the medium leading edge in the rib at the time of being fed backward easily occurs. In addition, even in a case of having a somewhat strong paper stiffness (rigidity), influence of curls also becomes large as a size increases, and getting-caught of the medium leading edge in the rib at the time of being fed backward easily occurs. Therefore, it is reasonable to prioritize prevention of the medium having a large size from getting caught in the rib over prevention of the medium having a small size from getting caught in the rib, from the viewpoint of obtaining a good recording result as a whole.

In a configuration including the first ribs 48 and 50 (FIGS. 4 and 5) and the second ribs 52 and 54 (FIGS. 5, 6A, and 6B), the second ribs 52 and 54 (FIGS. 6A and 6B) have the guide surfaces 52*d* and 54*d*, respectively, for scooping up the leading edge of the medium which is fed backward from the downstream side to the upstream side in the medium transport direction. The guide surfaces 52*d* and 54*d* include the first guide surface 52*d* (FIG. 6A) which is formed on each of the second ribs 52 positioned within the first region W1 (FIG. 5) in the medium width direction, and the second guide surface 54*d* (FIG. 6B) which is formed on each of the second ribs 54 positioned in the second region W2 positioned outside the first region W1 in the medium width direction, in which the medium transport direction-downstream side end portion 54*e* of the second guide surface 54*d* is positioned on a downstream side from the medium transport direction-downstream side end portion 52*e* of the first guide surface 52*d* and has a lower height position h3 than the height position h2 for the medium transport direction-downstream side end portion 52*e* of the first guide surface 52*d*.

That is, in the second region W2 outside the first region W1, the second guide surface 54*d* for scooping up the medium leading edge is formed to be longer and from a lower side. Thus, the leading edge of the medium having a large size, for example, the medium P3, can be prevented from getting caught in the rib.

On the other hand, in the first region W1, the first guide surface 52*d* for scooping up the medium leading edge is shorter than the second guide surface 54*d*. Thus, a region between the second rib 52 and the third rib 56 can be secured wide, and restrictions on the ink ejection nozzles at the time of performing the borderless recording can be loosened, thereby preventing a recording throughput from being lowered.

The printer 10 further includes a plurality of third ribs 56 (FIGS. 5, 6A, and 6B) which are positioned on a downstream side from the second ribs 52 and 54 in the medium transport direction and are spaced apart from one another at an appropriate interval in the medium width direction, in which the recording head 28 has the plurality of ink ejection nozzles along the medium transport direction (Y axis direction), and in which the recording apparatus is capable of executing the first recording mode, in which the ink ejection nozzles to be used are restricted to the ink ejection nozzles which are positioned within the range between the medium transport direction-downstream side end portion 54*e* of the second guide surface 54*d* and the upstream side end portion 56*a* of each of the third ribs 56 in the medium transport direction, in a case where recording is performed on the medium P3 of which the edge portions in the medium width direction (X axis direction) are positioned outside the first region W1 (FIG. 5), and the second recording mode, in which the ink ejection nozzles are positioned within the range between the medium transport direction-downstream side end portion 52*e* of the first guide surface 52*d* and the upstream side end portion 56*a* of each of the third ribs 56 in the medium transport direction and are used in a larger number than the ink ejection nozzles used in the first recording mode, in a case where recording is performed on the medium P2 of which the edge portions in the medium width direction are positioned within the first region W1.

In the above configuration, by applying the second recording mode to the medium P2 of which the width direction-edge portions are positioned within the first region W1, that is, the medium having a relatively small size, it is possible to use a larger number of ink ejection nozzles, thereby preventing a recording throughput from being lowered.

The printer 10 further includes a plurality of fourth ribs 58, 60, and 62 (FIGS. 7 and 8) which are positioned on a downstream side from the third ribs 56 in the medium transport direction and are spaced apart from one another at an appropriate interval in the medium width direction, in which the plurality of ink ejection nozzles are configured to include the first nozzle group 66 (FIG. 9) including the ink ejection nozzles which face a region between the first ribs 48 and 50 (FIGS. 4 and 5) and the second ribs 52 and 54 (FIGS. 5, 6A, and 6B) in the medium transport direction (Y axis direction), the second nozzle group 68 (FIG. 9) including the ink ejection nozzles which face a region between the second ribs 52 and 54 and the third ribs 56 (FIGS. 5, 6A, and 6B) in the medium transport direction, and the third nozzle group 70 including the ink ejection nozzles which face a region between the third ribs 56 and the fourth ribs 58, 60, and 62 (FIGS. 7 and 8) in the medium transport direction. In the first recording mode, use of the ink ejection nozzles constituting the second nozzle group 68 is restricted (ink ejection region 68-1, FIG. 9), and the number of the ink ejection nozzles constituting the first nozzle group 66 or the third nozzle group 70 (ink ejection region 66-1 or 70-1, FIG. 9) matches the number of the ink ejection nozzles used in the second nozzle group 68.

In the above configuration, in a case where inks of different colors (cyan, magenta, and yellow) are ejected from the first nozzle group 66, the second nozzle group 68, and the third nozzle group 70, and this is repeatedly done on the medium, an appropriate recording result can be obtained.

In the recording job in which recording is performed on both the first surface of the medium P3 and the second surface opposite to the first surface, the control section 46 for controlling the transport roller 40 starts backward feeding of the medium P3 at the position where the trailing edge P3F of the medium P3 for which recording on the first surface has been completed does not proceed to a downstream side from the third ribs 56. In this configuration, the medium trailing edge P3F does not need to climb over the third ribs 56 when the medium P3 is fed backward, that is, it is possible to reduce the number of ribs over which the medium leading edge (trailing edge P3F) passes when the medium is fed backward, thereby suppressing a probability of jamming.

The plurality of fourth ribs 58, 60, and 62 (FIG. 8) provided along the medium width direction (X axis direction) are formed to have uneven heights. In this configuration, by adjusting the heights of the fourth ribs 58, 60, and 62 in response to the heights of the corrugation shaped valleys formed on the medium, it is possible to prevent the medium leading edge from colliding with the ribs and to realize a more appropriate transport of the medium.

The position of the medium transport direction-upstream side end portion 52*a* (FIG. 6A) of each of the second ribs 52 positioned within the first region W1 (FIG. 5) and the position of the medium transport direction-upstream side end portion 54*a* (FIG. 6B) of each of the second ribs 54 positioned in the second region W2 (FIG. 5) positioned outside the first region W1 match at the position Y3. In this configuration, it is possible to allow the intervals between the first ribs 48 and 50 and the second ribs 52 and 54 in the medium transport direction (Y axis direction) to match with one another in the medium transport direction. As a result, regardless of a medium size, a region between the first ribs 48 and 50 and the second ribs 52 and 54 can be maximally used.

The ribs 48, 50, 52, 54, 56, 58, 60, and 62 (FIG. 5) have the upstream guide surfaces 48*b* (FIG. 4), 50*b* (FIG. 4), 52*c* (FIG. 6A), 54*c* (FIG. 6B), 58*b* (FIGS. 4 and 9), 60*b* (FIG. 4), and 62*b* (FIGS. 4 and 9) for scooping up the leading edge of the medium which is fed forward from the upstream side to the downstream side in the medium transport direction. In this configuration, when the medium is transported in the forward feeding direction, it is possible to prevent the medium leading edge from getting caught in the ribs 48, 50, 52, 54, 56, 58, 60, and 62.

The entire disclosure of Japanese Patent Application No. 2017-089390, filed Apr. 28, 2017 is expressly incorporated by reference herein.

What is claimed is:

1. A recording apparatus comprising:

a recording head which performs recording on a medium, the medium having a center region in a medium width direction and a pair of outer regions, one outer region of the pair of outer regions being disposed on each side of the center region in the medium width direction; and a support member which is disposed to face the recording head and on which a plurality of ribs for supporting the medium are formed;

wherein the plurality of ribs include:

a plurality of first ribs which are spaced apart from one another at an appropriate interval in the medium width direction that is a direction intersecting with a medium transport direction in which the medium is fed towards the recording head, and a plurality of second ribs which are positioned on a downstream side in the medium transport direction from the first ribs, and are spaced apart from one another at an appropriate interval in the medium width direction, the plurality of second ribs including a first set of second ribs and a second set of second ribs, the first set of second ribs being disposed within the center region in the medium width direction, and the second set of second ribs being disposed only on both of the pair of outer regions next to both of the sides of the center region and an outer edge of the support member in the medium width direction, wherein each second rib of the first set of the second ribs has a first guide surface, and each second rib of the second set of the second ribs has a second guide surface, each of the first guide surfaces and second guide surfaces being configured to scoop up a leading edge of the medium that is fed backwards from the downstream side in the medium transport direction to an upstream side in the medium transport direction, wherein each of the first and second guide surfaces is formed by at least a vertical surface, a horizontal surface, an angled surface, and a connecting portion where the vertical surface and the angled surface are connected, wherein the connecting portion of the second guide surface, on the downstream side of each second rib of the second set of the second ribs, is positioned downstream from the connecting portion of the first guide surface on the downstream side of each second rib of the first set of the second ribs, and the connecting portion of the second guide surface of each second rib of the second set of the second ribs has a lower height position than the connecting portion of the first guide surface of each second rib of the first set of the second ribs, wherein the plurality of ribs further include a plurality of third ribs which are positioned on a downstream side from the plurality of second ribs in the medium transport direction and are spaced apart from one another at an appropriate interval in the medium width direction, wherein the recording head has a plurality of ink ejection nozzles along the medium transport direction, and wherein the recording apparatus is capable of executing a first recording mode, in which the ink ejection nozzles to be used are restricted to a first set of the plurality of ink ejection nozzles which are positioned within a range between the connecting portion of each second guide surface and an upstream side end portion of each of the third ribs in the medium transport direction, and in the first recording mode, recording is performed on a wide medium of which edge portions in the medium width direction are positioned outside the center region, a second recording mode, in which a second set of the plurality of ink ejection nozzles are positioned within a range between the connecting portion of each first guide surface and the upstream side end portion of each of the third ribs in the medium transport direction, and in the second recording mode, recording is performed on a narrow medium of which edge portions in the medium width direction are positioned within the center region, and the second set of the plurality of ink ejection nozzles includes a larger number of nozzles than the first set of the plurality of ink ejection nozzles, wherein the plurality of ribs further include a plurality of fourth ribs which are positioned on a downstream side from the third ribs in the medium transport direction and are spaced apart from one another at an appropriate interval in the medium width direction, wherein the plurality of ink ejection nozzles are configured to include:

a first nozzle group including the ink ejection nozzles which face a region between the first ribs and the second ribs in the medium transport direction, a second nozzle group including the ink ejection nozzles which face a region between the second ribs and the third ribs in the medium transport direction, and a third nozzle group including the ink ejection nozzles which face a region between the third ribs and the fourth ribs in the medium transport direction, and wherein in the first recording mode, use of the ink ejection nozzles constituting the second nozzle group is restricted, and the number of the ink ejection nozzles constituting the first nozzle group or the third nozzle group matches the number of the ink ejection nozzles used in the second nozzle group.

2. The recording apparatus according to claim 1, further comprising:

an upstream side transport unit which is provided on an upstream side of the support member in a medium transport direction;

a control unit which controls the upstream side transport unit, wherein in a recording job in which recording is performed on both a first surface of the medium and a second surface opposite to the first surface, the control unit starts backward feeding of the medium at a position where the trailing edge of the medium for which recording on the first surface has been completed does not proceed to a downstream side from the third ribs.

3. The recording apparatus according to claim 1, wherein the plurality of fourth ribs provided along the medium width direction are formed to have uneven heights.

4. The recording apparatus according to claim 1, wherein a position of the medium transport direction-upstream side end portion of each of the second ribs positioned within the first region and a position of the medium transport direction-upstream side end portion of each of the second ribs positioned outside the first region match with each other.

5. The recording apparatus according to claim 1, wherein each of the ribs has an upstream guide surface for scooping up the leading edge of the medium which is fed forward from the upstream side to the downstream side in the medium transport direction.

6. The recording apparatus according to claim 1, wherein an inclination angle of the first guide surface and an inclination angle of the second guide surface are the same.

* * * * *